United States Patent [19]

Dollman et al.

[11] Patent Number: 4,668,305

[45] Date of Patent: May 26, 1987

[54] METHOD FOR THE PRODUCTION OF CHROMIUM PHOSPHATE COATINGS

[75] Inventors: David Y. Dollman, Doylestown; Mark W. McMillen, Perkasie, both of Pa.

[73] Assignee: Amchem Products, Inc., Ambler, Pa.

[21] Appl. No.: 689,197

[22] Filed: Jan. 7, 1985

[51] Int. Cl.[4] ..... C23C 22/33
[52] U.S. Cl. ..... 148/6.16
[58] Field of Search ..... 148/6.16

[56] References Cited

U.S. PATENT DOCUMENTS

| | | | |
|---|---|---|---|
| 2,438,877 | 3/1948 | Spruance | 148/6.16 |
| 2,472,864 | 5/1949 | Spruance | 148/6.16 |
| 2,678,291 | 5/1954 | Spruance | 148/6.16 |
| 3,481,797 | 12/1967 | Leland | 148/6.16 |

*Primary Examiner*—Sam Silverberg
*Attorney, Agent, or Firm*—Ernest G. Szoke; Henry E. Millson, Jr.

[57] ABSTRACT

The life of chromium phosphate coating baths is extended by at least fully restoring depleted $Cr^{VI}$; bath efficiencies are significantly improved.

24 Claims, No Drawings

METHOD FOR THE PRODUCTION OF CHROMIUM PHOSPHATE COATINGS

BACKGROUND OF THE INVENTION

1. Field of the Invention

This invention relates to $H_3PO_4/CrO_3$ coating baths for metal surfaces, and in particular to a method for extending the useful life of known $H_3PO_4/CrO_3$ coating baths and to a method of applying chromium phosphate coatings.

2. Statement of the Related Art

In order to deposit high-weight chromium phosphate coatings on metal surfaces (e.g., more than about 300 mg/ft$^2$ or about 3.24 g/m$^2$) active coating baths are employed to treat the substrate, causing high levels of displaced metal ions to build up rapidly in the bath. Since the presence of these ions in excess results in loose, powdery coatings, the baths must be discarded and renewed at frequent intervals, which is expensive and also creates waste disposal problems. A particular problem is presented by zinc-bonded aluminum surfaces of the type prepared by processes such as the ALFUSE process, (trademark of Modine Mfg. Corp., Racine, Wisc., U.S.A.) in which high zinc deposition ratios are employed. The use of an active $H_3PO_4/CrO_3$ coating bath on these substrates results in high levels of dissolved Zn and Al in the bath, which interfere with the coating process and rapidly decrease the useful life of the bath. Although replenishers for renewing $H_3PO_4/CrO_3$ baths are commercially available, such prior art replenishers characteristically have $CrO_3$ and $H_3PO_4$ ratios comparable to fresh bath ratios; as a result, the useful life of baths replenished with these materials is not usually remarkably extended.

DESCRIPTION OF THE INVENTION

This invention relates to a method for replenishing used $H_3PO_4CrO_3$ coating baths employed in the production of chromium phosphate coatings on aluminum surfaces, especially zinc bonded aluminum surfaces and to a method of applying the chromium phosphate coatings. It has been found that increasing the relative $CrO_3$ (hexavalent chromium or $Cr^{VI}$) content of the used coating bath effectively counteracts the tendency of the chromium phosphate coatings to become loose and powdery as the dissolved aluminum content of the bath increases over time. The concept is particularly applicable to aluminum metal surfaces coated with zinc or similar metals, especially those produced by deposition of zinc from a zinc chloride flux onto an aluminum surface such as that produced by the above mentioned ALFUSE process.

According to the present invention, the metal substrate is treated with a conventional $H_3PO_4/CrO_3$ coating bath. Such baths typically contain a mole ratio of $H_3PO_4$ to $CrO_3$ of about 2.5–3.0:1, preferably about 2.80–2.90:1, and have a usual hydrofluoric acid content of about 0.5 to about 2.0 grams per liter. Exemplary commercial replenisher formulations for these baths include ALODINE® 401, 405, 406 and 407, (proprietary compositions of Amchem Products, Inc., Ambler, Pa., U.S.A.), which contain representative mole ratios of $H_3PO_4$ to $CrO_3$ of about 2.90:1.0 at concentrations of $H_3PO_4$ and $CrO_3$ of about 650 g/l (grams/liter) and 225 g/l, respectively. Coating baths containing about 28 g/l $H_3PO_4$ and about 10 g/l $CrO_3$ are typically prepared by appropriate dilution of these replenisher formulations, usually to about 4–5% by volume. HF is then added to activate the bath sufficiently to obtain coatings of the desired weight on the metal substrate.

As previously noted, coating weights in excess of about 300 mg/ft$^2$ require an active bath, wherein dissolved metal from the substrate rapidly builds up in the bath. Generally at a dissolved metal content above about 10 g/l, reaction products in these coating baths, especially dissolved aluminum and zinc, begin to promote loose and powdery coatings. At this point, conventional baths are considered to be exhausted, and are discarded. It has unexpectedly been discovered, however, that replenishment of these coating baths with a replenisher composition having an unusually high relative $CrO_3$ content markedly extends the useful life of the bath. While the present concept is particularly applicable to coating processes adapted to produce relatively heavy coatings of from about 300–450 mg/ft$^2$, the concept is broadly applicable to processes for producing a chromium phosphate coating having a weight of from about 5 to 600 mg/ft$^2$. (0.054 to 6.48 g/m$^2$).

In accordance with the present invention, the $CrO_3$ content of a used coating bath is increased at least about sufficiently to restore the bath to at least its original $CrO_3$ concentration usually of about 10 g/l and preferably up to about 150% of its original concentration usually of about 15 g/l, while maintaining the $H_3PO_4$ content of the bath substantially constant. Surprisingly, the adverse effects of the high metal ion content of the bath are thus effectively counteracted, and a two-to three-fold increase in bath life is usual. The addition can be repeated as required, until no longer effective.

The $CrO_3$ content of the coating bath can be gradually replenished or increased on a continuing basis or an appropriate amount of $CrO_3$ may be repeatedly added batchwise as the bath nears exhaustion. Exhausted baths are characterized by the production of loose and powdery coatings, attributable to an excessive dissolved metal content. Dissolved metal content can be conveniently monitored by determination of the $Cr^{III}$ content by known methods. While particular systems will vary, a bath concentration of $CR^{III}$ of about $\frac{1}{3}$ of starting $Cr^{VI}$ concentration generally signifies imminent bath exhaustion, and the bath should be renewed at or before this point. Exhaustion of the bath is also characterized by decreasing bath efficiency (wt. dissolved metal/wt. of coating produced). Generally, as the bath deteriorates, the weight of dissolved metal increases and, also, the coating weight decreases, with significant concomitant losses in coating efficiency. Increasing the hexavalent chromium concentration of a used bath according to the present invention not only yields tight coatings at relatively high dissolved metal concentrations (e.g., 20 or more g/l dissolved metal), but also significantly improves bath efficiency, as will be shown in the examples which follow. To restore the coating baths according to the invention, a sufficient amount of $CrO_3$ is added to the used bath to restore the $Cr^{VI}$ content thereof to at least about the levels present in the fresh bath; a typical bath containing about 10 g/l of $CrO_3$ when fresh will require an increase in concentration of at least about 0.034 moles $CrO_3$ near the exhaustion point to restore bath efficiency, if the exhaustion point is taken as the point wherein about $\frac{1}{3}$ of $Cr^{VI}$ has been reduced.

To achieve this end, replenishers having a mole ratio of $H_3PO_4$ to $CrO_3$ substantially lower than the comparable ratios in prior art make-up and replenishers are conveniently employed. Replenishers having a $H_3PO_4$ to $CrO_3$ mole ratio of about 1.10 to 1.25:1 are suitable, and those having a mole ratio ($H_3PO_4$:$CrO_3$) of about 1.13 to 1.18:1 are particularly suitable. Such replenishers contrast sharply with prior art replenishers having characteristic $H_3PO_4$:$CrO_3$ ratios in excess of 2.80:1.

The following Examples are illustrative of the practice of the invention.

EXAMPLES

A.

Methods

1. $Cr^{III}$ Determination: RT-AT v. Total Aluminum Dissolved.

RT is "Reaction Titration" (total $Cr^{+6}$ and $Cr^{+3}$) and AT is "Alodine® Titration" ($Cr^{+6}$ titration). To monitor dissolved aluminum, $Cr^{+3}$ is oxidized and then titrated as $Cr^{+6}$ by known methods. The difference (RT−AT) represents the amount of $Cr^{+3}$ present in the used bath, which is a measure of the amount of dissolved (oxidized) metal present. The amount of $Cr^{+3}$ in the bath is easily determined by this titration and provides a quick method for determination of dissolved metal, by calculation against a standard (RT−AT v. total metal dissolved). In an exemplary application: a fresh bath with no metal dissolved contains 10 g $CrO_3$ per liter (0.1 mole); for this bath, 15 mL 0.1N thiosulfate is required to starch endpoint on a iodimetric titration using a 5 mL aliquot. When the used bath attains an RT-AT value of 20RT−15AT=5.0, by calculation to standard approximately 11.5 g per liter of dissolved metal as aluminum and zinc is present in the bath, and loose coatings are almost certain in baths formulated for 300 to 400 mg per sq.ft. of coating weight. An RT−AT of 5.0 in this system calculates as 3.34 g/L of reduced $CrO_3$, or 0.034 moles. A new bath adjustment is required by the time the reduced $CrO_3$ ($Cr^{+3}$) reaches $\frac{1}{3}$ of the concentration of the original hexavalent Cr content.

2. Bath Efficiency Determination

As coatings are formed, some metal dissolves from the surface of the substrate parts. The efficiency of the bath is determined by comparing the initial weight of a substrate part with the coated and stripped substrate part weights. The part is weighed and processed through the bath; the coated weight of the part is noted, the coating is then stripped, and the stripped weight of the part noted. For an example, in a 4"×6" aluminum panel:

(1) Initial Wt.=24.8755 g
(2) Coated Wt.=24.9719 g
(3) Stripped Wt.=24.8333 g

Bath efficiency is defined herein as the weight of metal dissolved per unit of coating weight produced, and calculated as follows:

Initial wt. less stripped wt.=metal dissolved

Coated wt. less stripped wt.=coating wt.

In this case No. 1–No. 3 is the metal dissolved, or 42.2 mg. The coating weight is calculated from No. 2–No. 3 as 138.6 mg of coating produced on this panel. Then, $$\frac{\text{Wt. Metal (Al) Dissolved}}{\text{Coating Weight}} =$$

-continued $$\frac{42.2\text{ mg.}}{138.6\text{ mg}} = 0.304 \text{ (calculated efficiency value)}$$

An increase in the calculated efficiency value reflects a decrease in the efficiency of the bath.

For example, the same bath which has reached exhaustion may have the following exemplary efficiency:

(1) Initial Wt. of aluminum part: 24.5290 g
(2) Coated Wt. of aluminum part: 24.5990 g
(3) Stripped Wt. of aluminum part: 24.4690 g (Employing comparable 4"×6" aluminum panels). The bath efficiency is $$\frac{\text{Al Dissolved}}{\text{Coating Wt.}} = \frac{60.0\text{ mg}}{130.0\text{ mg}} = 0.461$$

Thus, for each gram of coating produced, 0.461 grams of aluminum is being dissolved into the bath with equivalent reduction of $Cr^{VI}$ to $Cr^{III}$. Note that both the dissolved metal value has increased and coating weight values have decreased over the comparable values in the preceding calculation, indicating that both increased metal content and decreased coating weight may result from bath exhaustion, and that either or usually both these phenomena may contribute to decreased bath efficiency. (It is noted that coating weights are usually expressed in weight per sq. ft. of surface; since the surface area is constant in these determinations, this parameter is omitted. As the test panels have a surface area of $\frac{1}{3}$ sq. ft., coating weights in mg/ft$^2$ are here obtained by multiplying coating weight in mg. by 3.)

EX. I

Replenisher Formulation

A replenisher is prepared as follows:

350 g $CrO_3$ and 330 ml 75% $H_3PO_4$ are combined with water to a total volume of 1 liter.

The $H_3PO_4$:$CrO_3$ mole ratio is 3.987:3.5=1.139:1 (350 g $CrO_{3/1}$ and 390.72 g $H_3PO_{4/1}$).

EX. II

Replenisher Formulation

A replenisher is prepared as follows:

327 g $CrO_3$ is admixed with 325 mL 75% $H_3PO_4$, and $H_2O$ to a total volume of 1 liter.

The $H_3PO_4$:$CrO_3$ mol ratio is 1.20:1 (327 g $CrO_{3/l}$ and 386.9 g $H_3PO_{4/l}$).

EX. III

Coating Process According to Invention

A field trial was conducted on a prior art bath close to exhaustion. The $CrO_3$ content of this bath was increased by 3.34 g per liter or 0.034 moles to a $Cr_{O3}$ concentration of 13.34 g/l from the original concentration by addition of $CrO_3$. Table 1 below shows the results of this increase in hexavalent chromium while holding $H_3PO_4$ and HF constant.

TABLE 1

| Value | Before Adjustment | ½ hr After Adjustment |
|---|---|---|
| AT (sodium thiosulphate) (ml) | 14.3 | 19.4 |
| RT (ml) | 21.1 | 26.4 |
| RT-AT (ml) | 6.8 | 7.0 |
| Zinc (g/l) | 7.25 | 7.20 |

TABLE 1-continued

| Value | Before Adjustment | ½ hr After Adjustment |
|---|---|---|
| Aluminum (g/l) | 7.55 | 7.40 |
| Initial Wt. (g) | 25.6434 | 24.5290 |
| Coated Wt. (g) | 25.7210 | 24.6230 |
| Stripped Wt. (g) | 25.5791 | 24.4738 |
| Efficiency | 0.453 | 0.368 |
| Coating Wt. ($mg/ft^2$) | 425.7 | 448.8 |

Note the improvement in bath efficiency and increase in coating weight. After the first adjustment, this bath was replenished with replenisher according to Example I for two more days with continued success until one 55 gallon drum was used. Subsequent efficiencies over the course of this one 55 gallon drum of replenishment were 0.347, 0.357, 0.365, 0.371 and 0.380. At termination, the bath contained 9.85 g zinc and 11.5 g aluminum per liter or a total of 21.4 g of metal. Prior baths could only tolerate about 12 or 13 g/l of dissolved metal before producing loose coatings. (cf. Ex. V).

The following table shows the laboratory titrations, including free acid (F.A.) and total acid (T.A.). The free acid values indicate that the reduced phosphoric acid in the replenisher employed was at a high enough concentration to keep the free acid at a constant level.

TABLE 2

| Sample No. | Time | Comment | AT | RT | RT − AT | FA | TA | pH | g/l Zn | g/l Al | g/l Metal | Efficiency |
|---|---|---|---|---|---|---|---|---|---|---|---|---|
| 1 | Wed. 0700 | Table/bath before adjustment | 14.3 | 21.1 | 6.8 | 2.3 | 8.4 | 1.54 | 7.25 | 7.55 | 14.80 | 0.453 |
| 2 | Wed. 0730 | Add 3.34 g $CrO_3$/L | 19.4 | 26.4 | 7.0 | 2.4 | 8.7 | 1.54 | 7.20 | 7.40 | 14.60 | 0.368 |
| 3 | Wed. 1500 | Adding Ex. I Replenisher | 21.8 | 30.0 | 8.2 | 2.5 | 9.3 | 1.40 | 8.15 | 9.55 | 17.70 | 0.357 |
| 4 | Thurs. 1000 | End of addn. of Ex. I Replenisher | 24.1 | 35.8 | 11.7 | 2.5 | 10.5 | 1.52 | 9.30 | 10.95 | 20.25 | 0.365 |
| 5 | Thurs. 1330 | No Additions | 22.3 | 34.5 | 12.2 | 2.5 | 10.5 | 1.58 | 9.85 | 11.55 | 21.40 | 0.371 |
| 6 | Thurs. 1500 | Discard | 21.7 | 34.5 | 13.0 | 2.5 | 10.6 | 1.63 | 10.30 | 12.10 | 22.40 | 0.368 |

The run ended at Thurs. 1500, at which time the bath was discarded. Note the F.A. remained constant, which indicates sufficient $H_3PO_4$. No. 2 had 0.368 efficiency after $CrO_3$ addition; thereafter efficiency slightly decreased from 0.357 to 0.368 at discard time.

No partial bath stabilization was done. In typical prior art systems, 20% of the bath is discarded at noon and 30% at 3 p.m. of each day of operation to stabilize the bath and prolong useful life. The present invention thus saves on make-up chemical, and expense of disposing of discarded bath.

EX. IV

Coating Process According to Invention

A comparable field test was run with the replenisher of Ex. II, a diluted version of the replenisher employed in Ex. III. As a comparison with the bath composition used in Example V below, the bath ran for a week without stabilization. The metal content of the bath rose to 16 g/l zinc and 16 g/l aluminum with a RT−AT value of 15 mL without producing powdery coatings and while maintaining a bath efficiency below 0.45. In this same amount of time, twice the volume of a conventional bath would have been dumped via bath stabilization (i.e., discard of bath and replenishment with equal volume of prior art replenisher).

EX. V

Comparison Example—Prior Art Coating Process

The following data represents a prior art field run. A commercial bath (28 g/l $H_3PO_4$, 10 g/l $CrO_3$) was monitored from start to finish. The typical buildup of aluminum and zinc is shown in the following chart. Analysis via atomic absorption on the samples taken at 8 a.m., noon, and 3 p.m. are presented. At 3 p.m., a portion of the bath was discarded, and water and an additional quantity of the above commercial bath (mole ratio of $CrO_3$:$H_3PO_4$ of 1.0:2.89; 227 g/l $CrO_3$, 645 g/l $H_3PO_4$) were added to reduce the dissolved metal (Al+Zn) content for the next day's run.

TABLE 3

| DAY | TIME | Concentration in ppm ZINC | ALUMINUM | METAL |
|---|---|---|---|---|
| 1 | 8 a.m. | 1 | 0 | 1 |
| | Noon | 1097 | 591 | 1688 |
| | 3 p.m. | 2050 | 1131 | 3181 |
| 2 | 8 a.m. | 1750 | 981 | 2731 |
| | Noon | 1825 | 1016 | |
| | 3 p.m. | 1902 | 1151 | 3053 |
| 3 | 8 a.m. | 1618 | 909 | |
| | Noon | 2267 | 1371 | |
| | 3 p.m. | 2534 | 1576 | 4110 |
| 4 | 8 a.m. | 2257 | 1470 | |
| | Noon | 2680 | 2040 | |
| | 3 p.m. | 3738 | 2576 | 6314 |
| 5 | 8 a.m. | 3012 | 1996 | |
| | Noon | 4012 | 2782 | |
| | 3 p.m. | 4655 | 3359 | 8014 |
| 6 | 8 a.m. | 3881 | 2660 | |
| | Noon | 4741 | 3255 | |
| | 3 p.m. | 5283 | 3583 | 8866 |
| 7 | 8 a.m. | 4351 | 2974 | |
| | Noon | 5189 | 3491 | |
| | 3 p.m. | 5771 | 3827 | 9598 |
| 8 | 8 a.m. | 4586 | 3064 | |
| | Noon | 5243 | 3563 | |
| | 3 p.m. | 5786 | 3892 | 9678 |
| 9 | 8 a.m. | 4619 | 3117 | |
| | Noon | 5333 | 3493 | |
| | 3 p.m. | 5991 | 3875 | 9866 |
| 10 | 8 a.m. | 4881 | 3249 | |
| | Noon | 5643 | 3768 | |
| | 3 p.m. | 6571 | 4032 | 10,603 |

As is apparent, even with daily bath stabilization, the total dissolved metal content reached 10.6 g/l. At this time loose coatings were persistent and the total bath as discharged to treatment and disposal.

What is claimed is:

1. A method for extending the useful life of a fresh $CrO_3/H_3PO_4$ active coating bath for applying a relatively heavy chromium phosphate coating having a weight of at least about 300 mg/ft$^2$ to a zinc-bonded aluminum substrate comprising adding sufficient $CrO_3$ to a used coating bath to increase the $Cr^{VI}$ concentration thereof to a concentration above the $Cr^{VI}$ concentration of the fresh bath at or before the exhaustion point of the fresh bath, while maintaining the free acid content of the used bath substantially constant over the extended life thereof and while maintaining the $H_3PO_4$ content of the bath at the concentration of the fresh bath.

2. The method of claim 1, wherein the $CrO_3$ concentration is increased to up to about 150% of the original $CrO_3$ concentration.

3. The method of claim 1, wherein $CrO_3$ is added when about one-third of the original $Cr^{VI}$ content has been reduced, to $Cr^{III}$.

4. The method of claim 1, wherein $CrO_3$ is added when the dissolved metal content of the bath exceeds about 10 g/l.

5. The method of claim 1 for extending the useful life of a fresh coating bath wherein the $CrO_3$ is added to increase the $Cr^{VI}$ concentration to above the $Cr^{VI}$ concentration of the fresh bath when about one-third of the original $Cr^{VI}$ has been reduced to $Cr^{III}$ and the dissolved metal content exceeds about 10 g/l, thereafter during use of the bath continuously or repeatedly adding $Cr_3$ to the bath, to increase the $Cr^{VI}$ above the $Cr^{VI}$ concentration of the fresh bath, until the dissolved metal content exceeds about 20 g/l and the bath is exhausted.

6. The method of claim 5 wherein the mole ratio of $H_3PO_4$ to $CrO_3$ in the fresh bath is from about 2.5 to 3.0:1 and the fresh bath contains about 10 g/l $CrO_3$, and the $CrO_3$ is continuously or periodically added to the bath to restore the $CrO_3$ content to 10 to 15 g/l.

7. The method of claim 1, wherein the $CrO_3$ is added in the form of a replenisher composition having a mole ratio of $H_3PO_4$ to $CrO_3$ of from about 1.10–1.25:1.

8. The method of claim 7, wherein the mole ratio of $H_3PO_4$ to $CrO_3$ is from about 1.13–1.18:1.

9. The method of claim 1, wherein the mole ratio of $H_3PO_4$ to $CrO_3$ in the fresh coating bath is from about 2.5–3.0:1.

10. The method of claim 1, wherein the fresh coating bath contains about 10 g/l $CrO_3$.

11. The method of claim 1, wherein the fresh coating bath has a mole ratio of $H_3PO_4$ to $CrO_3$ of about 2:80–2.90:1 and an HF content of about 0.5 to about 2 g/L.

12. The method of claim 1, wherein the $Cr^{VI}$ content of the coating bath is continuously increased above the $Cr^{VI}$ concentration of the fresh bath as $CrO_3$ is reduced.

13. The method of claim 1, wherein the $Cr^{VI}$ content of the coating bath is repeatedly increased above the $Cr^{VI}$ concentration of the fresh bath by sequential batchwise additions of $CrO_3$ to the bath at or near each exhaustion point thereof.

14. The method of claim 5 wherein the $CrO_3$ concentration of the bath is continuously or repeatedly increased until the dissolved metal content exceeds about 20 to 32 g/l and the bath is exhausted.

15. The method of claim 10, wherein $CrO_3$ is added to provide a concentration of about 13 g/l in the used bath.

16. A method for extending the useful life of a fresh $H_3PO_4/CrO_3$ coating bath for applying a relatively heavy chromium phosphate coating having a weight of at least about 300 mg/ft$^2$ to a zinc-aluminum substrate, without periodically discarding bath solution to stabilize the bath, wherein the $H_3PO_4/Cr_{O3}$ in the fresh bath has a mole ratio of 2.5 to 3.0:1.0 and the $CrO_3$ has a concentration of about 10 g/l, which method comprises using the bath to coat zinc-aluminum substrate until the dissolved concentration of zinc and aluminum exceeds a value of about 10 g/l; adding $H_3PO_4/CrO_3$ to the bath at a mole ratio of about 1.10 to 1.25:1.0 to obtain a $CrO_3$ concentration in the bath of from more than 10 up to about 15 g/l while maintaining the $H_3PO_4$ content of the bath at the concentration of the fresh bath and a substantially constant free acid content; continuing to use the bath to coat the zinc-aluminum substrate; periodically adding additional $H_3PO_4/CrO_3$ to the bath, each time as the bath nears exhaustion, at a mole ratio of about 1.10 to 1.25:1.0 to obtain a $CrO_3$ concentration in the bath of from more than 10 up to about 15 g/l and a substantially constant free acid content; and continuing to use the bath to coat zinc-aluminum substrate until the dissolved aluminum and zinc concentration in the bath exceeds a value of about 20.0 g/l, and the bath is exhausted.

17. The method of claim 16, wherein the bath is an active bath adapted to produce a relatively heavy coating of from about 300–450 mg/ft$^2$.

18. The method of claim 16, wherein the $Cr^{VI}$ content of the coating bath is repeatedly increased by sequential batchwise addition of $H_3PO_4/CrO_3$ to the bath at or near each exhaustion point thereof.

19. The method of claim 16 wherein the bath has a pH of between about 1.4 and 1.58.

20. A method for applying a chromium phosphate coating having a weight of at least about 300 mg/ft$^2$ to a zinc-bonded aluminum substrate, without periodically discarding bath solution to stabilize the bath, which comprises treating the zinc-aluminum substrate in a fresh $H_3PO_4/CrO_3$ active coating bath solution, wherein the $H_3PO_4/CrO_3$ has a mole ratio of about 2.5 to 3.0:1.0 and the $CrO_3$ has a concentration of about 10 g/l; coating the zinc aluminum substrate with chromium phosphate until the concentration of dissolved zinc and aluminum in the bath exceeds a value of about 10 g/l; adding $H_3PO_4/CrO_3$ to the bath at a mole ratio of about 1.10 to 1.25:1.0 to obtain a $CrO_3$ concentration in the bath of from more than 10 up to about 15 g/l while maintaining the $H_3PO_4$ content of the bath at the concentration of the fresh bath and a substantially constant free acid content; continuing to coat the zinc aluminum substrate with the chromium phosphate; periodically adding additional $H_3PO_4/CrO_3$ to the bath, each time as the bath nears exhaustion, at a mole ratio of about 1.0 to 1.25:1.0 to obtain a $CrO_3$ concentration in the bath of from more than 10 up to about 15 g/l and a substantially constant free acid content; and continuing to coat the zinc-aluminum substrate with chromium phosphate until the concentration of dissolved aluminum and zinc in the bath exceeds a value of about 20.0 g/l and the bath is exhausted.

21. The method of claim 20, wherein the bath is an active bath adapted to produce a relatively heavy coating of from about 300–450 mg/ft$^2$.

22. The method of claim 20, wherein the $Cr^{VI}$ content of the coating bath is repeatedly increased by sequential batchwise addition of $H_3PO_4/CrO_3$ to the bath at or near each exhaustion point thereof.

23. The method of claim 20 wherein the bath has a pH between about 1.4 pH and 1.58 pH.

24. The method of claim 20 wherein the bath has a HF content of about 0.5 to 2.0 g/l.

* * * * *